US011122671B1

(12) United States Patent
Lu et al.

(10) Patent No.: US 11,122,671 B1
(45) Date of Patent: Sep. 14, 2021

(54) LIGHT TUBE WITH ANTI-ELECTRIC SHOCK PROTECTION FUNCTION AND CAPABLE OF BEING SUPPLIED WITH ELECTRICITY BY ELECTRICAL BALLAST AND ALTERNATE-CURRENT POWER SUPPLY IN WORKING FREQUENCY

(71) Applicant: Xiamen PVTECH Co., Ltd., Fujian (CN)

(72) Inventors: Fuxing Lu, Fujian (CN); Rongtu Liu, Fujian (CN)

(73) Assignee: Xiamen PVTECH Co., Ltd., Fujian (CN)

( * ) Notice: Subject to any disclaimer, the term of this patent is extended or adjusted under 35 U.S.C. 154(b) by 0 days.

(21) Appl. No.: 17/002,787

(22) Filed: Aug. 26, 2020

(30) Foreign Application Priority Data

Jun. 1, 2020 (CN) ..... 202010485485.3

(51) Int. Cl.
*H05B 47/25* (2020.01)
*F21V 25/10* (2006.01)
*F21Y 103/00* (2016.01)

(52) U.S. Cl.
CPC ..... *H05B 47/25* (2020.01); *F21V 25/10* (2013.01); *F21Y 2103/00* (2013.01)

(58) Field of Classification Search
None
See application file for complete search history.

(56) References Cited

U.S. PATENT DOCUMENTS

| | | | | |
|---|---|---|---|---|
| 9,986,619 | B2 * | 5/2018 | Hsia | H05B 47/26 |
| 2014/0265900 | A1 * | 9/2014 | Sadwick | H05B 45/395 315/200 R |
| 2016/0081147 | A1 * | 3/2016 | Guang | H05B 45/3578 315/123 |
| 2017/0079100 | A1 * | 3/2017 | Park | F21K 9/00 |
| 2017/0311396 | A1 * | 10/2017 | Sadwick | H05B 47/25 |
| 2018/0119893 | A1 * | 5/2018 | Liu | F21K 9/278 |

* cited by examiner

*Primary Examiner* — Amy Cohen Johnson
*Assistant Examiner* — James H Cho
(74) *Attorney, Agent, or Firm* — Winston Hsu

(57) ABSTRACT

A light tube with anti-electric shock protection function and capable of being supplied with electricity by electrical ballast and alternate-current power supply in working frequency includes two conductive pin assemblies, a bridge rectifier, an anti-electric shock detection control circuit, a direct-current filtering circuit, a bleeder resistor, a buck-boost constant current module, and a rectifier. The direct-current filtering circuit is connected to the anti-electric shock detection control circuit and the bleeder resistor. The direct-current filtering circuit performs a smoothing procedure to a direct-current pulse voltage signal which is rectified by the bridge rectifier, the direct-current filtering circuit generates a false voltage to the anti-electric shock detection control circuit, and the bleeder resistor reduces the false voltage. The rectifier is connected to the bridge rectifier to receive a rectifier circuit, and the electrical ballast inputs the voltage signal to the bridge rectifier.

8 Claims, 1 Drawing Sheet

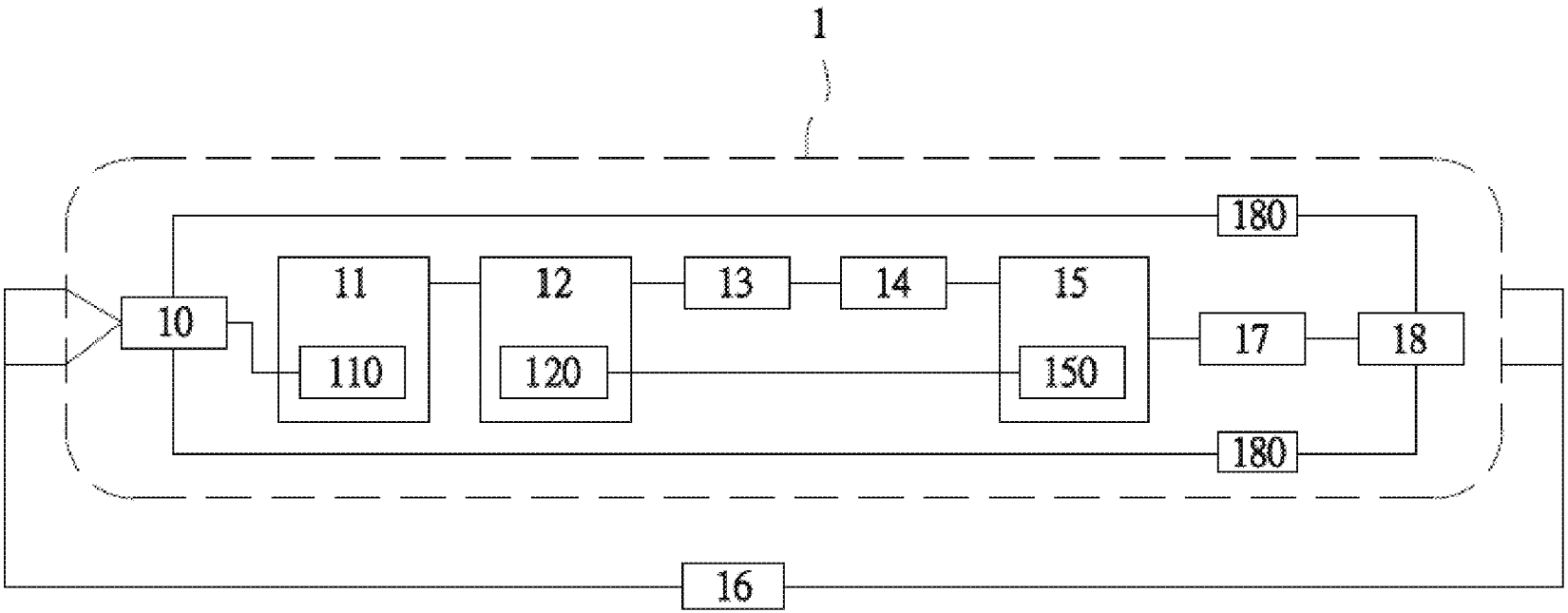
1
10
11
110
12
120
13
14
15
150
180
17
18
180
16

LIGHT TUBE WITH ANTI-ELECTRIC SHOCK PROTECTION FUNCTION AND CAPABLE OF BEING SUPPLIED WITH ELECTRICITY BY ELECTRICAL BALLAST AND ALTERNATE-CURRENT POWER SUPPLY IN WORKING FREQUENCY

BACKGROUND OF THE INVENTION

1. Field of the Invention

The present invention relates to a light tube, in particular to a light tube with anti-electric shock protection function and capable of being supplied with electricity by electrical ballast and alternate-current power supply in working frequency.

2. Description of the Prior Art

For existing light tubes that are capable of being supplied with electricity by electrical ballast and alternate-current power supply, following problems occur. The first problem is that, the structure of the circuit of the light tube is complicated. Hence, during manufacturing the light tube, quality control for the material has to be strictly required to a certain small material error, thereby causing the material suppliers with a higher demand. The second problem is that, cost of the power supply material as well as cost of the human workforce. Since a plenty of components are used during processing the product, cost for the components and cost for the processing procedures increase. The third problem is that, the input manner and the power supply for the light tube are too simple. As a result, the existing monotone configuration is not sufficient to achieve the function of two-pins input (no matter single end or dual end) in the premise of implementing the anti-leakage protection. Hence, for different application fields, the existing light tubes have different input configurations, thereby not only increasing the complexity of the manufactured products but also increasing the inventory costs for the distributors. The fourth problem is that, the existing light tube cannot perform the dimming function when being supplied with electricity by the electrical ballast. Most of the electrical ballasts for fluorescent light tubes are provided with a dimming function. Hence, when the replaced products for the existing light tubes cannot meet the dimming demands, the application experience for the end user will be affected. As a result, the existing light tubes cannot be replaced completely. The fifth problem is that, when the existing light tube is supplied with electricity by the electrical ballast, the power for the entire light cannot be greatly adjusted. It is understood that, even in some cases the power for the light tube is adjustable, the adjustable range of the power of the light tube is limited. As a result, when the end user replaces the light tube with another, due to the reduction of the luminous flux to cause the reduction of the overall luminance for the replaced light tube, the illumination experience provided by the replaced light tube is decreased. Hence, the light tube that is capable of being supplied with electricity by electrical ballast and alternate-current power supply cannot be properly replaced.

Therefore, how to address the issues is to be considered.

SUMMARY OF THE INVENTION

In view of these, in one embodiment, a light tube with anti-electric shock protection function and capable of being supplied with electricity by electrical ballast and alternate-current power supply in working frequency is provided. the light tube comprises two conductive pin assemblies disposed at two ends of the light tube and electrically connected to a mains supply; a bridge rectifier connected to the conductive pin assemblies and being capable of inputting at least one type of voltage signals; an anti-electric shock detection control circuit connected to the bridge rectifier and having an output end; a direct-current filtering circuit connected to the anti-electric shock detection control circuit and a bleeder resistor, wherein the direct-current filtering circuit performs a smoothing procedure to a direct-current pulse voltage signal which is rectified by the bridge rectifier and the direct-current filtering circuit generates a false voltage to the anti-electric shock detection control circuit, and the bleeder resistor reduces the false voltage; a buck-boost constant current module having an input end connected to the output end; a rectifier connected to the bridge rectifier to receive a rectifying circuit, wherein the rectifier is capable of inputting the voltage signal to the bridge rectifier, and a loop connected to the rectifier comprises at least one capacitor.

In one or some preferable implementations of the light tube with anti-electric shock protection function and capable of being supplied with electricity by electrical ballast and alternate-current power supply in working frequency, the bridge rectifier further comprises at least one capacitor.

In one or some preferable implementations of the light tube with anti-electric shock protection function and capable of being supplied with electricity by electrical ballast and alternate-current power supply in working frequency, the capacitance of the capacitor is in a range from 4.7 nF to 47 nF.

In one or some preferable implementations of the light tube with anti-electric shock protection function and capable of being supplied with electricity by electrical ballast and alternate-current power supply in working frequency, the voltage signal is an alternate current voltage signal or an electrical ballast voltage signal.

In one or some preferable implementations of the light tube with anti-electric shock protection function and capable of being supplied with electricity by electrical ballast and alternate-current power supply in working frequency, an overall resistance of the bleeder resistor is in a range from 470 KΩ to 2 MΩ.

In one or some preferable implementations of the light tube with anti-electric shock protection function and capable of being supplied with electricity by electrical ballast and alternate-current power supply in working frequency, the bridge rectifier is connected to an external electrical ballast through the conductive pin assemblies.

In one or some preferable implementations of the light tube with anti-electric shock protection function and capable of being supplied with electricity by electrical ballast and alternate-current power supply in working frequency, the capacitance of the capacitor is in a range from 4.7 nF to 47 nF.

In one or some preferable implementations of the light tube with anti-electric shock protection function and capable of being supplied with electricity by electrical ballast and alternate-current power supply in working frequency, the light tube further comprises a light bead structure connected to the external electrical ballast having a larger voltage or connected to the mains supply having a small voltage.

In one or some preferable implementations of the light tube with anti-electric shock protection function and capable of being supplied with electricity by electrical ballast and alternate-current power supply in working frequency, when the power of the light tube is supplied by the electrical ballast, the bridge rectifier is a high performance bridge rectifier or is formed by high performance rectifying diodes.

Based on the above, the light tube according to one or some embodiments has following advantages. The main circuit for the electrical ballast power supply mode can be simplified in the premise of ensuring the anti-electric shock protection, and reliable regular capacitors and high performance bridge rectifier are used to replace the complicated electrical detection and control driving manner. Moreover, the dimming requirements for the light tube can be achieved when the light tube is in the electrical ballast power supply mode.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The FIGURE illustrates a schematic block diagram of a light tube with anti-electric shock protection function and capable of being supplied with electricity by electrical ballast and alternate-current power supply in working frequency according to an exemplary embodiment of the present invention.

DETAILED DESCRIPTION

The detailed description of the technical content, structural features, and the objects and effects of the technical solutions will be described in detail below with reference to the specific embodiments and the accompanying drawings.

Please refer to the FIGURE, which illustrate a schematic block diagram of a light tube with anti-electric shock protection function and capable of being supplied with electricity by electrical ballast and alternate-current power supply in working frequency, according to an exemplary embodiment of the present invention. A light tube with anti-electric shock protection function and capable of being supplied with electricity by electrical ballast and alternate-current power supply in working frequency is provided, and the light tube 1 comprises two conductive pin assemblies 10, a bridge rectifier 11, an anti-electric shock detection control circuit 12, a direct-current filtering circuit 13, a bleeder resistor 14, and a buck-boost constant current module 15. The two conductive pin assemblies 10 are respectively disposed at two ends of the light tube 1 and are electrically connected to the mains supply. The bridge rectifier 11 is connected to the conductive pin assemblies 10 and is capable of inputting at least one type of voltage signals (alternate-current voltage signal or electrical ballast voltage signal). The anti-electric shock detection control circuit 12 is connected to the bridge rectifier 11 and has an output end 120 (the AC input anti-electric protection circuit, therefore during the installation of the light tube 1, even if one end of the light tube 1 is connected to the fire wire of the AC voltage and the other end of the light tube 1 is in contact with human body, the human body can be prevented from getting electric shock). The direct-current filtering circuit 13 is connected to the anti-electric shock detection control circuit 12 and a bleeder resistor 14. The direct-current filtering circuit 13 performs a smoothing procedure to a direct-current pulse voltage signal which is rectified by the bridge rectifier 11. The direct-current filtering circuit 13 generates a false voltage to the anti-electric shock detection control circuit 12. The bleeder resistor 14 reduces the false voltage. The input end 150 of the buck-boost constant current module 15 is connected to the output end 120 of the anti-electric shock detection control circuit 12. An electrical ballast 16 is provided for supplying electricity, mainly by an external power installation, and the electrical ballast 16 is connected to the bridge rectifier 11 through the conductive pin assemblies 10 to receive a rectifier circuit and inputs the voltage signal (which is an electrical ballast voltage signal) to the bridge rectifier 11.

The light tube 1 further comprises a light bead structure 17. The light bead structure 17 is connected to the external electrical ballast 16 having a larger voltage or connected to the main supply having a smaller voltage. Moreover, the bridge rectifier 11 further comprises at least one capacitor 110. When the light tube 1 is supplied with the mains supply, the capacitor 110 of the bridge rectifier 11 is served as the filtering capacitor; when the light tube 1 is supplied with the external electrical ballast 16, the capacitor 110 of the bridge rectifier 11 is served as a foolproof resistor.

When the voltage signal received by the bridge rectifier 11 is the alternate-current voltage signal from the mains supply, the capacitor 110 of the bridge rectifier 11 is served as the filtering capacitor of the bridge rectifier 11.

When the voltage signal received by the bridge rectifier 11 is the electrical ballast voltage signal from the electrical ballast 16 externally, since the loop connected to the rectifier 18 comprises at least one capacitor 180, and the capacitance of the capacitor 180 is in a range from 4.7 nF to 47 nF (which is referred as the larger current case), the electrical ballast voltage signal which is a larger voltage is directly inputted to the bridge rectifier 11 in the electrical ballast mode. In the electrical ballast mode (namely, when the voltage signal received by the bridge rectifier 11 is from the electrical ballast 16), the capacitor 180 is served as the main power loop, and the capacitor 110 of the bridge rectifier 11 is served as the foolproof capacitor. It is worthy to mention that, when the power of the light tube is supplied by the electrical ballast, the bridge rectifier may be a high performance bridge rectifier or is formed by high performance rectifying diodes.

The direct-current filtering circuit 13 is connected to the anti-electric shock detection control circuit 12 and the bleeder resistor 14. When the anti-electric shock detection control circuit receives the alternate-current voltage signal of the bridge rectifier 11 from the mains supply, since the voltage of the mains supply is relatively smaller, the mains supply can be directly connected to the direct-current filtering circuit 13 through the bleeder resistor 14 to perform the anti-electric shock detection of the mains supply. Moreover, the anti-electric shock detection control circuit 12 ensures that, during the installation of the light tube 1, even if one end of the light tube 1 is connected to the fire wire of the AC voltage and the other end of the light tube 1 is in contact with human body, the human body can be prevented from getting electric shock. It is worthy to mention that, the overall resistance of the bleeder resistor 14 is in a range from 470 KΩ to 2 MΩ, and thus upon performing the anti-electric shock detection for the mains supply, the main supply is connected to the direct-current filtering circuit 13 through the bleeder resistor 14 for the detection.

As above, the main circuit for the electrical ballast power supply mode can be simplified in the premise of ensuring the anti-electric shock protection, and reliable regular capacitors and high performance bridge rectifier are used to replace the complicated electrical detection and control driving manner.

Moreover, the dimming requirements for the light tube can be achieved when the light tube is in the electrical ballast power supply mode.

Although particular embodiments of the invention have been described in detail for purposes of illustration, various modifications and enhancements may be made without departing from the spirit and scope of the invention. Accordingly, the invention is not to be limited except as by the appended claims.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A light tube with anti-electric shock protection function and capable of being supplied with electricity by electrical ballast and alternate-current power supply in working frequency, comprising two conductive pin assemblies disposed at two ends of the light tube and electrically connected to a mains supply; a bridge rectifier connected to at least one of the two conductive pin assemblies and being inputted at least one type of voltage signals; an anti-electric shock detection control circuit connected to the bridge rectifier and having an output end; a direct-current filtering circuit connected to the anti-electric shock detection control circuit and a bleeder resistor, wherein the direct-current filtering circuit performs a smoothing procedure to a direct-current pulse voltage signal which is rectified by the bridge rectifier and the direct-current filtering circuit generates a false voltage in response to an output of the anti-electric shock detection control circuit, and the bleeder resistor reduces the false voltage; a buck-boost constant current module having an input end connected to the output end; a rectifier connected to the bridge rectifier to receive a rectifying signal, wherein the rectifier is inputting the at least one type of voltage signals to the bridge rectifier, and a loop connected to the rectifier comprises at least one capacitor.

2. The light tube according to claim 1, wherein the bridge rectifier further comprises at least one second capacitor.

3. The light tube according to claim 1, wherein the at least one type of voltage signals is an alternate current voltage signal or an electrical ballast voltage signal.

4. The light tube according to claim 1, wherein an overall resistance of the bleeder resistor is in a range from 470 KΩ to 2 MΩ.

5. The light tube according to claim 1, wherein the bridge rectifier is connected to an electrical ballast through the conductive pin of the two conductive pin assemblies.

6. The light tube according to claim 5, further comprising a light bead structure connected to the electrical ballast having a larger voltage or connected to the mains supply having a smaller voltage.

7. The light tube according to claim 5, wherein when a power of the light tube is supplied by the electrical ballast, the bridge rectifier is a high performance bridge rectifier or is formed by high performance rectifying diodes.

8. The light tube according to claim 1, wherein the capacitance of the at least one capacitor is in a range from 4.7 nF to 47 nF.

* * * * *